US006082125A

United States Patent [19]

Savtchenko

[11] Patent Number: 6,082,125

[45] Date of Patent: Jul. 4, 2000

[54] HEAT PUMP ENERGY MANAGEMENT SYSTEM

[76] Inventor: Peter Savtchenko, Unit 2, 7 Stoddart Road, Prospect NSW, Australia, 2149

[21] Appl. No.: 09/125,658

[22] PCT Filed: Feb. 24, 1997

[86] PCT No.: PCT/AU97/00106

§ 371 Date: Aug. 21, 1998

§ 102(e) Date: Aug. 21, 1998

[87] PCT Pub. No.: WO97/31230

PCT Pub. Date: Aug. 28, 1997

[30] Foreign Application Priority Data

Feb. 24, 1997 [AU] Australia ..... PN 8280

[51] Int. Cl.[7] ..... F25B 27/00

[52] U.S. Cl. ..... 62/238.6; 62/238.7; 62/199; 62/200

[58] Field of Search ..... 62/238.6, 238.7, 62/199, 200

[56] References Cited

U.S. PATENT DOCUMENTS

| | | | |
|---|---|---|---|
| 5,058,392 | 10/1991 | Jouan et al. | 62/238.6 |
| 5,560,216 | 10/1996 | Holmes | 62/161 |
| 5,680,898 | 10/1997 | Rafalovich et al. | 165/236 |
| 5,778,696 | 7/1998 | Conner | 62/238.6 |
| 5,802,864 | 9/1998 | Yarbrough et al. | 62/238.6 |
| 5,906,104 | 5/1999 | Schwartz et al. | 62/79 |

*Primary Examiner*—Henry Bennett
*Assistant Examiner*—Mark Shulman
*Attorney, Agent, or Firm*—Lyon & Lyon LLP

[57] ABSTRACT

An energy management system is disclosed that includes first, second and third heat exchangers, a compressor to provide compressed refrigerant for selective delivery to the heat exchangers, an expansion valve for the first and second heat exchangers for selectively delivering expanding refrigerant thereto, and a control valve communicating with the heat exchangers, expansion valves and compressor. The control valve coordinates circulation of the refrigerant so that compressed refrigerant may be delivered to the third heat exchanger, and expanding refrigerant delivered to the first or second heat exchangers; or compressed refrigerant may be delivered to the first or third heat exchangers, and expanding refrigerant delivered to the second heat exchanger; or compressed refrigerant may be delivered to the second heat exchanger, and expanding refrigerant delivered to the first heat exchanger; or expanding refrigerant may be delivered to the third heat exchanger, and compressed refrigerant delivered to the first or second heat exchangers. The control valve is also configured to drain refrigerant from any one of the heat exchangers, when inoperative, to the compressor.

7 Claims, 8 Drawing Sheets

HEAT PUMP ENERGY MANAGEMENT SYSTEM

TECHNICAL FIELD

The present invention relates to an energy management system, and in particular, to a system for monitoring and distributing thermal energy between at least three heat exchangers (heating and cooling devices).

In particular, the present invention relates to an energy management system which for example, may be utilised to provide air cooling whilst simultaneously utilising rejected heat from the air cooling means for heating, for example, water provided in a domestic hot water heater, a swimming pool, or the like. When satisfied, excess energy can be rejected to atmosphere, as necessary.

The present invention also relates to a three way valve device which may be utilised with the energy management system of the present invention, or, in other applications.

The present invention also relates to the use of refrigerant diversion valves within the energy management system, such that, the same circuitry, i.e. flow paths, may be utilised in different configurations, wherein different energy requirements are demanded to circulate the refrigerant through heat exchangers being water, air type and/or the like.

BACKGROUND OF THE INVENTION

Present day society has grown accustomed to living in a thermally controlled environment, that is, an environment which is "conditioned" by being either heated or cooled to a comfortable level. Not only is the temperature, humidity, etc. of the air controlled, but also, present day society demands the instantaneous provision of "on-tap" hot and cold water, swimming pools heated to a comfortable level, etc. For example, in the domestic situation, it is not uncommon for persons to demand an air conditioned home with a heated pool, etc. Holiday resorts have even more demanding requirements, such as air conditioned rooms, heated swimming pools, refrigerated rooms for containment of foodstuffs, high temperature rooms such as saunas, etc.

Obviously, all these individual components of a domestic, business or resort premises have high demands for energy, which result in high fuel prices. With the increased cost of fuel, and electricity in recent times, such systems have consequently become more and more expensive to operate.

Not only do persons demand such controlled environments, but, they demand different comfort levels in different seasons. That is, the demands of winter and summer, for example, are different.

OBJECT OF THE INVENTION

It is the object of the present invention to overcome or substantially ameliorate the above disadvantages.

SUMMARY OF THE INVENTION

There is disclosed herein a heat transfer assembly comprising:

- a first, second and third heat exchanger;
- a compressor to provide compressed refrigerant for selective deliver to the heat exchangers;
- an expansion valve for each of said first and second heat exchangers to selectively deliver expanding refrigerant thereto;
- a control valve assembly communicating with the heat exchanges, expansion valves and compressor to coordinate circulation of the refrigerant so that compressed refrigerant can be delivered to said third heat exchanger and expanding refrigerant delivered to said first or second heat exchangers, or compressed refrigerant is delivered to said first or third heat exchangers and expanding refrigerant delivered to said second heat exchanger, or compressed refrigerant delivered to said second heat exchanger and expanding refrigerant delivered to said first heat exchanger, or expanding refrigerant is delivered to said third heat exchanger and compressed refrigerant is delivered to said first or second heat exchangers, said valve assembly also being configured to drain refrigerant from any one of said first, second or third heat exchangers, when inoperative, to said compressor.

There is further disclosed herein the heat transfer assembly of claim 1, wherein said valve assembly includes a first, a second and a third valve device, said first valve device coupling said first heat exchanger with said compressor to receive refrigerant from or deliver refrigerant to the compressor, and connecting the second valve device to said compressor so as to deliver compressed refrigerant thereto, said second valve device being connected to said third heat exchanger to deliver compressed refrigerant thereto or to drain refrigerant therefrom for delivery to the compressor, and to deliver compressed refrigerant to said second heat exchanger or drain refrigerant therefrom for delivery to said compressor, said third valve device being connected to said first heat exchanger via the expansion valve associated therewith to isolate or to receive refrigerant from or deliver refrigerant to said first heat exchanger, said third valve device also being connected to said second heat exchanger via the expansion valve associated therewith to isolate or to deliver refrigerant to or receive refrigerant from the second heat exchanger, said third valve device further being coupled to said third heat exchanger to isolate the third heat exchanger or to receive refrigerant therefrom or to deliver refrigerant thereto.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

FIGS. 1 to 4 illustrate, in flow chart form, the provision of various components which might be utilised to simultaneously provide a thermal cooling means such as an air conditioning unit, and thermal warming means, such as a swimming pool heater.

Figure 1:
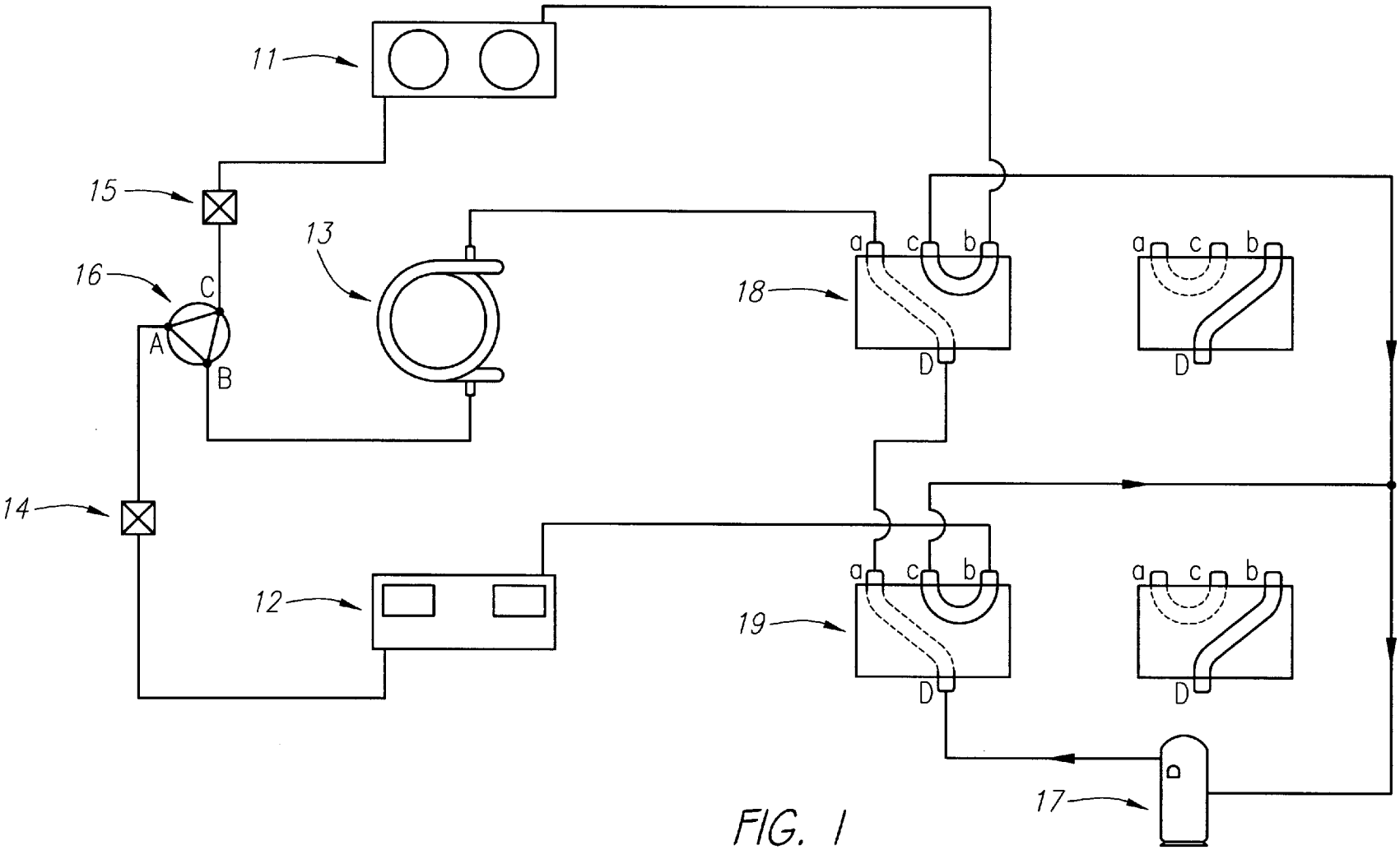
FIG. 1 shows a first embodiment of the energy management system in accordance with a first aspect of the present invention, in schematic form.

In FIG. 1 is shown a first embodiment of the energy management system (heat transfer assembly) of the present invention. This embodiment is well suited to domestic situations, commercial premises, such as resorts, hotels, motels, nursing homes and the like. The embodiment is particularly appropriate when both pool heating and air conditioning are required. This system can of course also be used for other similar applications, such as a dedicated hot water generator for the recovery of energy from commercial clothes drier and/or air conditioners, or, for heat recovery for cooling laundry space recovered to portable hot water storage. The system hereinafter describes the embodiment of a pool heater and air conditioner as the heat recovery energy management system.

It will be understood that this system is particularly useful for air conditioning and green-house heating by water heater tubes in the glass house, for laundry clothes-drier heat recovery to a portable hot water supply, for laundry heat recovery to effect cooling, the energy being provided to portable hot water, for air conditioning to concrete hot-water circuit slab heating, for air conditioning multi-storey cooling tower water circuit, for dissipating or collection of energy and simultaneous heating and cooling for a multi-storey office on the sunned side of a building and heating the shaded side of structure, or, for air-conditioning twin fan coils with the use of water-cooling tower.

In FIG. 1, the Outside Fan Coil is designated by numeral 11. The outside coil 11 may comprise a propeller or centrifugal type fan for the movement of air passing through a tube-type device having aluminium extended fins. Such coil is commonly known as a condenser coil (when used for heating purposes), and is used for the rejection of thermal energy from a highly super heated discharge refrigerant gas from the compressor during the summer months. The coil 11 is also used as an evaporator (when used for cooling purposes) for the collection of energy from the ambient environment during the winter months.

The Indoor Fan Coil Evaporator, designated 12, has a centrifugal scroll fan commonly used in industry for the circulation of air through a tube-type aluminium extended fin coil. The coil 12 is used for cooling in summer, where energy is collected by the refrigerant as it passes through these coils at a much lower temperature than that of the air, the refrigerant consequently evaporating, i.e., turning from a liquid to a gas, to thereby absorb heat energy. This component 12 is also used as a condenser to dissipate heat energy to heat the inside living space for air heating during winter.

The pool-water cooled heat exchanger is designated 13. Primarily, the pool heat exchanger is a condenser wherein highly super heated discharge gas is cooled, where it gives up its thermal energy to the pool water. It is also used as an evaporator to collect energy from the water.

The Thermostatic expansion valves, (TX valves) are designated 14 and 15. Their prime function is to expand refrigerant from a liquid to a vaporous gas state, due to a pressure drop being created to allow evaporation to occur. The thermostatic expansion valves 14 and 15 regulate the amount of refrigerant into the evaporator for the efficient collection of energy. They may be air type heat exchangers or water type heat exchangers, and may be optionally vented, or the like.

The valve, labelled 16, is a special purpose component, designed and built to provide the bi-flow multi directional operational functions. When Ports A and C are open, Port B is closed. When Port A and B are open, Port C is closed, and when Port B and C are open, Port A is closed. The operation of the valve 16 will be described more fully hereinafter with reference to FIGS. 5 to 8.

With these port configurations it is possible to divert refrigerant to different thermal heat exchangers, as required, to either dissipate energy or collect energy.

The Compressor, labelled 17, is to create the refrigeration effect. As refrigerant vapour enters the low pressure suction port of the compressor, it is compressed via piston or other rotary, turbine or vane-type compressor, thereby reducing its volume. The function of this is to increase the temperature of the refrigerant gas. As cooling occurs, the highly super heated discharge vapour in the thermal heat exchanger loses its thermal energy, saturating back to a liquid, where it can be reused.

The refrigerant diversion valves 18 and 19, each have four ports. Their function is to change the refrigerant flow.

The refrigerant diversion valves 18 and 19 in this system design are used for the function of diverting the refrigerant from one heat exchanger to another, and, are used for relieving refrigerant, and allowing it to be recovered by the compressor suction to be used in another part of the system, upon demand. The discharge direction also changes, providing a new path for the energy entrained in the highly super heated discharge gas vapour. By manipulating the valve electrically, the position of the U-shaped yolk can be changed from a non-energised state to an energised state. In the non-energised state, the path of flow is between ports D and a, and ports c and b. In the energised state, the path of flow is between ports D and b, and ports a and c. The energised state is shown in unbroken curved lines, whilst the non-energised state is shown in broken curved lines.

The overall system described in FIG. 1 operates as follows.

For a summer cycle of operation, when the refrigerant diversion valve 19 is in the non-energised state, the indoor fan coil 12 is connected via ports c and b to the low pressure inlet of the compressor 17 with the high pressure discharge gas of the compressor 17 travelling from ports D to a. The high pressure gas enters diversion valve 18, which is non-energised, through it's D port and exists port a. It then enters the water cooled tube-in-the-tube heat exchanger 13. The highly super heated high pressure discharge gas vapour gives up its thermal energy to the pool water turning it back to a liquid refrigerant. It then travels through to the valve 16, entering port B. When cooling is in demand inside the home, the indoor fan coil is utilised when ports B and A are open, and when port C is closed. The refrigerant then enters the TX valve 14, and, the evaporation of the refrigerant starts in the indoor fan coil heat exchanger. When the inside temperature is satisfied the system will cycle off and on, controlled by the inside thermostat. The pool is also controlled with the use of a thermostat, and when the desired set point temperature is achieved and cooling is still required, the pool thermostat will signal that the valve 16 is to be energised to open ports A and C and to close port B. Simultaneously, diversion valve 18 is energised, relieving the pool water heat exchanger of the refrigerant that has been condensing therein. This refrigerant then flows back through ports a and c of diversion valve 18 returning back to the compressor intake, herein termed as the suction port. Since the diversion valve 18 has been energised the discharge now flows from port D to port b, to enter the finned tube type aluminium heat exchanger outside fan coil 11, and to dissipate discharge thermal energy to the outside environment with the use of highly superheated refrigerant vapour.

For a winter cycle of operation, home heating and pool heat may typically be required. The primary demand is the home heating, however that demand is only a relatively small requirement in comparison with the energy required in a 28° C. maintained swimming pool. The electronic management equipment shall therefore be programmed to service the home heating on priority, and utilise the best day time ambient factors to accommodate the pool heat load requirements. In most cases, home heating during the day time is not often in demand, as most people are at work. The pool heat load will be satisfied with the correct selection of equipment being sized to service the highest heat losses of the pool during the available running time in day light hours. However, on weekends and public holidays, the requirement for home heating will be firstly satisfied. The electronic management equipment is programmed to then initially service the heating demands for the home, and, once satisfied, then revert to heat the pool as required.

With the home requiring heating, diversion valve 19 is energised so as the high pressure discharge gas flows from port D to port b entering the indoor fan coil heat exchanger 12 to providing air heating. The highly super heated refrigerant gas vapour gives up its thermal energy to the air, to therefore become condensed back to a liquid. After travelling through the TX valve expansion device 14, it enters the valve 16, which has also been energised to open ports A and C and close off port B. As the refrigerant passes through this port configuration it enters the outside fan coil heat exchanger 11, expanding and collecting energy from the outside ambient air and turning the refrigerant into a vapour and returning it to the compressor 17, via ports c and b of the diversion valve 18 (which is non energised), to the suction port of the compressor 17 to once more repeat the refrigeration cycle. When the Home heating is satisfied and pool heating is still in demand, the diversion valve 19 is de-energised so as to let the discharge gas travel from port D to port a, and to enter diversion valve 18, (which is in a non-energised state). The discharge gas enters port D and exits port a to enter the pool water heat exchanger 13 where the highly super heated refrigerant gas vapour relinquishes its thermal energy to the pool water. Simultaneously the valve 16 is energised to open ports B and C and to close port A. The condensed liquid refrigerant then travels through the TX valve 15, evaporating the refrigerant into the outside fan coil heat exchanger 11 to collect energy from the outside ambient air. The refrigerant expands, collecting energy, turning into a vapour and returns via diversion valve 18 through ports c and b to the compressor 17 suction port. Hence the refrigeration cycle is complete.

A winter defrost cycle of operation occurs with the accumulation of frost on the outside fan coil heat exchanger 11, when the refrigerant temperature will be in most cases lower than 0° C. during winter. It is then necessary to provide a defrost cycle to prevent excessive build up of frost, which reduces the efficiency of the air-type extended aluminium finned tube heat exchanger. The electronic management equipment will be programmed to provide this defrost cycle whenever required, to maintain the optimum efficiency of the operation. It has priority over all functional demands, to maintain efficient operation. The defrost cycle will have a thermostat sensing the temperature of the outside fan coil and will initiate at −10° C. and will reset at +10° C. , when the defrost is complete. The defrost cycle of operation operates as follows. When the diversion valve 19 is de-energised, the discharge gas flows from port D to port a. After leaving port a, it enters port D of diversion valve 18 and leaves port b to enter the outside fan coil 11. As the highly super heated discharge gas vapour enters the outside fan coil heat exchanger 11 the frost build up is defrosted. When the thermostat reaches +10° C. , the system will service the functional demands as programmed into the electronic management equipment. The highly super heated discharge gas vapour therefore gives up its thermal energy to defrost the ice and therefore turn to a liquid refrigerant. It now enters the TX expansion device 15 and travels to the valve 16 which has been energised so that ports C and B are open and port A is closed. The expanding refrigerant collects thermal energy from the pool water which is at 28° C. As it turns to a vapour collecting thermal energy, it returns to the compressor via diversion valve 18 through ports a and c (which is energised) and enters the suction port of the compressor 17 to complete the defrost cycle.

Figure 2:
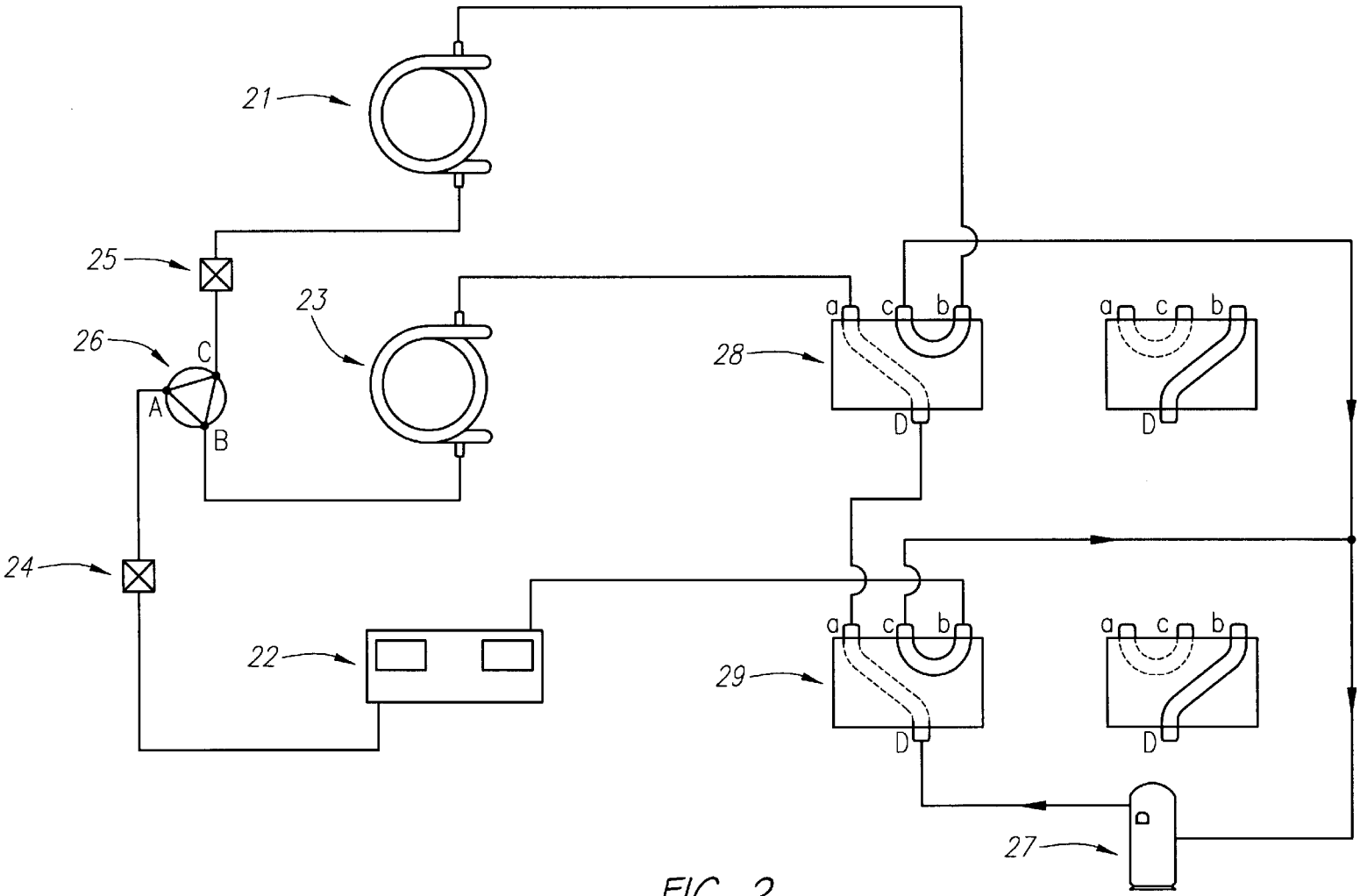
FIG. 2 shows a second embodiment of the system.

In FIG. 2 is shown a variation to the system illustrated in FIG. 1, being a second embodiment of the present invention. In FIG. 2, only one air type thermal heat exchanger is used, whilst two tube-within-a-tube type heat exchangers are utilised.

The embodiment of FIG. 2 would be well suited to a commercial laundry, a hotel, a motel, or nursing home hospital installation, wherein hot water is in demand continuously for washing etc. A commercial laundry working environment is a very hot and humid one, constituting a lower than average performance of employees working under these conditions. This system design is to take these parameters into consideration, to alleviate the harshness of these conditions and provide energy recovery and space cooling simultaneously. As the commercial laundry uses copious quantities of water, the cost of heating the water, and then, after use, discarding it down the drain, is expensive. With the use of a storage vessel or tank, the energy may be recovered before the water is discarded to waste. As the discarded hot water is not accumulated instantaneously, there will however be a period when recovery may not be practical. During this period, the recovery of energy from air cooling is possible inside the work space, until a sufficient amount of waste hot water for a recovery cycle is feasible.

Examples of other applications for this type of system include: air conditioning, pool heating and portable hot water; slab heating and portable hot water greenhouse water, and tube reticulated heating and cooling; pool heating and spa heating; pool heating of two separate pools; and, thermal storage cooling and heating tank or vessel simultaneously.

Details of the components illustrated in FIG. 2 are as follows. The heat recovery coil 21, operates with the assistance of a circulation pump to move water through the tube-in-tube-type heat exchanger coil. This type of coil is commonly known as an evaporator coil and is used for the recovery of thermal energy from waste hot water in a storage reservoir or the like.

The indoor fan coil evaporator 22 has a centrifugal scroll fan for the circulation of air through a tube type aluminium extended fin coil, used for energy recovery from air cooling. Where energy is collected by the refrigerant as it passes through these coils at a much lower temperature than that of the air, the refrigerant evaporates turning from a liquid to a gas thereby absorbing heat energy.

The hot water heat exchanger 23 is a tube-in-tube-type heat exchanger coil condenser, wherein a highly super heated discharge gas is cooled. It then gives up its thermal energy to the water in the hot water storage tank or the like.

The thermostatic expansion valves, (TX valves), 24 and 25 are primarily to expand refrigerant from a liquid to a vapour gas state, whereby a pressure drop is created to allow evaporation to occur. The thermostatic expansion valves 24 and 25 regulate the amount of refrigerant into the evaporator 22, for the efficient collection of energy.

The valve 26 is a special purpose valve, designed and built to provide the bi-flow multi directional operational functions. When ports A and C are open, port B is closed.

When ports A and B are open, and port C is closed, and, when ports B and C are open, port A is closed. With these port configurations it is possible to divert refrigerant to different thermal heat exchangers as required to either dissipate energy or collect energy when required.

The compressor 27 functions to create the refrigeration effect. As refrigerant is sucked into the suction port of the compressor 27 it is compressed via piston or other rotary, turbine or vane-type compressor, thereby reducing its volume and increasing the pressure and gas temperature. By cooling this now highly super heated discharge vapour in the thermal heat exchanger, the refrigerant loses its thermal energy and reconverts to a liquid, where it is able to be reused. Diversion valves 28 and 29 each have four ports, operable to change the refrigerant flow.

The diversion valve 28 and 29 in this system design is used for the function of diverting the refrigerant from one heat exchanger to another. It is also used for relieving refrigerant, to allow it to be recovered by the compressor suction to be used in another part of the system, upon demand. The discharge direction is also changed, providing another path for the energy entrained in the highly super heated discharge gas vapour. By manipulating the valve electrically, the position of a U-shaped yolk can be changed from a non-energised state to an energised state. In the non-energised state, the path of flow is between ports D and a, and ports c and b. Consequently, in the energised state, the path of flow is between ports D and b, and ports a and c. The energised state is shown in unbroken U-shaped curved lines, whilst the non-energised state is shown in broken U-shaped curved lines.

In the above described embodiment, the heat transfer assembly includes a first heat exchanger 22, a second heat exchanger 21, a third heat exchanger 23, expansion valves 24 and 25, a compressor 27, and a control valve assembly comprising valves 26, 28 and 29.

The system illustrated in FIG. 2 operates as follows. When hot water and air cooling heat recovery to portable water warming is performed, when diversion valve 29 is in the non-energised state, the indoor fan coil 22 utilises refrigerant suction to be relieved via ports b and c, and the discharge gas travels from port D to port a. After leaving diversion valve 29, the discharge enters diversion valve 28 through port D and exits port a, (which is also non-energised). It then enters the water cooled tube-in-tube hot water heat exchanger 23. The highly super heated discharge gas vapour gives up its thermal energy to the water, saturating it back to a liquid refrigerant. It then travels through to the valve 26, entering port A. With air recovery cooling in demand inside the work place, the indoor fan coil is utilised. When ports A and B are open and port C is closed, the refrigerant then enters the TX valve 24, where evaporation of the refrigerant starts in the indoor fan coil heat exchanger 22. Collecting energy from the work space, the refrigerant vapour leaves the fan coil evaporator 22 and enters port b of the diversion valve 29, to then exit out port c to return to the suction port of the Compressor 27 to thereafter be used in the repeated refrigeration cycle. Air cooling heat recovery will continue until such times as the water storage tank or vessel is full ready for the next hot water recovery cycle, or, until the uncontaminated fresh hot water temperature is satisfied. The hot water waste recovery reservoir temperature is controlled with the use of a thermostat, and when the desired minimum set point for the water temperature is achieved, the thermostat will signal to the electronic management equipment that the storage vessel or tank is to be drained via a float level switch. Hence, until the storage tank or reservoir is fined to activate the float switch to commence water energy recovery. The valve 26 is energised to open ports A and C and to close port B, to return to the hot water waste water recovery cycle.

Defrost cycle of operation is also provided, to eliminate the chance of the hot water waste recovery cooling coil tube-in-tube heat exchanger 21 freezing and being reduced in performance. The recovery of energy from the waste water may result in the accumulation of ice build-up in the waste water tube in rube water chiller evaporator coil heat exchanger, since the refrigerant temperature will be in most cases lower than 10° C. in accumulation may be prevalent. It is therefore necessary to provide a defrost cycle to prevent excessive build up of ice which would reduce the efficiency of the tube-in-tube water chiller evaporator heat exchanger 21. The electronic management equipment may be programmed to provide this de-ice cycle whenever it is required to ensure the optimum efficiency of the operation is maintained. It has priority over all functional demands to maintain efficient operation. The de-ice cycle will have a thermostat which senses the temperature of the tube-in-tube water chiller evaporator coil heat exchanger 21, and will initiate at 0° C. and will reset at +10° C. , when the defrost is complete. When the diversion valve 29 is energised, the discharge gas flows from port D to port a thereof. It then enters then enters port D of diversion valve 28, and leaves port b to enter the tube-in-tube water chiller evaporator coil heat exchanger 21. As the highly super heated discharge gas vapour enters the tube-in-tube water chiller evaporator coil heat exchanger 21, any ice build-up is defrosted. When the thermostat reaches +10° C. , the system will thereafter service the functional demands as programmed into the electronic management equipment. The highly super heated discharge gas vapour therefore gives up its thermal energy to defrost the ice and turn to a liquid refrigerant. It then enters the TX valve expansion device 25 and travels to the valve 26 which has been energised so that ports C and B are open and port A is closed. The expanding refrigerant collects thermal energy from the air inside the work space, and as it turns to a vapour it returns to the compressor via ports b and c of diversion valve 29 (which is non-energised) and enters the suction port of the compressor 27 to complete the cycle of operation.

Figure 3:
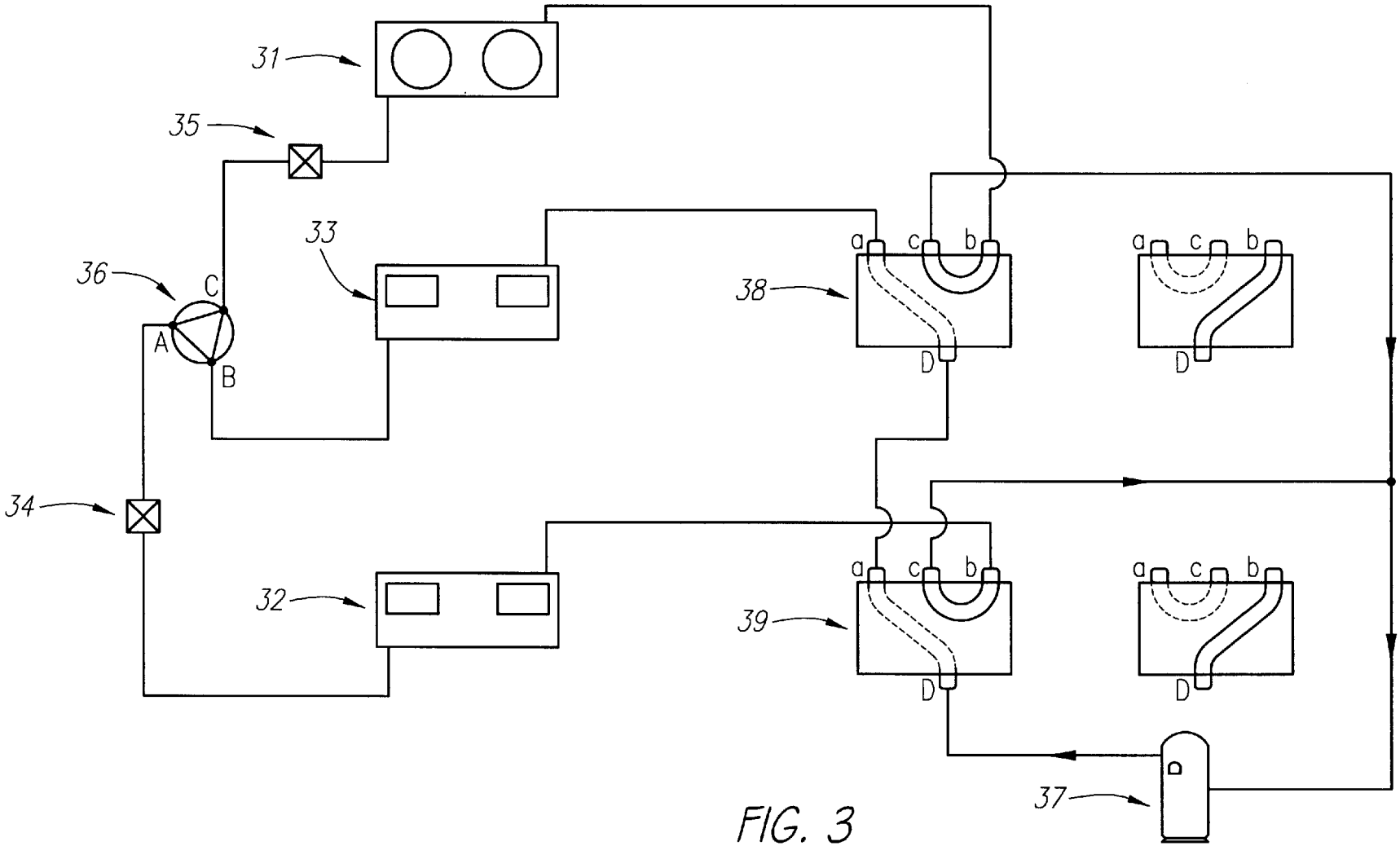
FIG. 3 shows a third embodiment of the system.

In FIG. 3 is shown another variation of the systems of FIGS. 1 and 2, constituting the third embodiment of the present invention. This embodiment has three air type tube with aluminium extended fin thermal heat exchangers.

This embodiment may be used to air condition two separate living or work spaces. In this case the domestic home will be used to describe the system. As a moderate sized home may typically require two separate heat pump systems to air condition two separate areas, one of which is seldomly used, only one outside unit heat exchanger with twin fan coil heat exchangers need be used to accomplish both air conditioning requirements.

Some of the typical other applications for this system are as follows: air conditioning cool room or freezer room; dehumidification drying room for product drying eg. fruits, plaster products etc.; computer room air conditioning and humidity control multi storey buildings for air conditioning sunned side and shaded side of building demand for cooling and heating simultaneously; twin cool room applications; and, twin freezers or dual temperature cool room and freezer room.

Details of the components illustrated in FIG. 3 are as follows.

The outside fan coil 31 is a propeller type fan for the movement of air passing through the tube type device with aluminium extended fins. This type of coil is commonly known as a condenser coil, used for the rejection of thermal energy from highly super heated discharge refrigerant gas from the compressor during summer months. It is also used as an evaporator for the collection of energy from the outside environment during the winter months.

The indoor fan coil evaporator 32 has a centrifugal scroll fan, commonly used for the circulation of air through tube type aluminium extended fin coils, used for cooling in summer. Energy is collected by the refrigerant as it passes through these coils at a much lower temperature than that of the air. The refrigerant evaporates, turning from a liquid to a gas, thereby absorbing heat energy. It is also used as a condenser to dissipate heat energy to heat the inside living space for air heating during winter.

The indoor fan coil evaporator 33 has a centrifugal scroll fan, commonly used for the circulation of air through tube type aluminium extended fin coils, used for cooling in summer, where energy is collected by the refrigerant as it passes through these coils at a much lower temperature than that of the air. The refrigerant evaporates, turning from a liquid to a gas thereby absorbing heat energy. It is also used as a condenser to dissipate heat energy to heat the inside living space for air heating during winter.

The primary function of the thermostatic expansion valve, (TX valves) 34 and 35 is to expand refrigerant from a liquid to a vapour gas state, whereby a pressure drop causes evaporation to occur. The thermostatic expansion valves 34 and 35 regulate the amount of refrigerant into the evaporator for the efficient collection of energy, whether an air type heat exchanger or water type heat exchanger, optionally vented, or the like, is used.

The valve 36 is again a special purpose device, to provide the bi-flow multi directional operational functions when ports A and C are open, port B is closed. When port A and B are open, port C is closed, and, when ports B and C are open, port A is closed. With these port configurations, it is possible to divert refrigerant to different thermal heat exchangers, as required, to either dissipate energy or collect energy.

The function of the compressor 37 is to create the refrigeration effect. As refrigerant is being sucked into the suction port of the compressor 37, it is compressed via piston or other rotary, turbine or vane-type compressor, thereby reducing its volume, with the result that the temperature of the gas increases. By cooling this now highly super heated discharge vapour in the thermal heat exchanger, the refrigerant loses its thermal energy saturating back to a liquid, where it can be reused time and time again.

The diversion valves 38 and 39 each comprise four tubes that are affixed, with the function of changing the refrigerant flow.

The diversion valve in this system design is used for the function of diverting the refrigerant from one heat exchanger to another. It is used for relieving refrigerant, and allowing it to be recovered by the compressor suction to be used in other parts of the system, upon demand. The discharge direction is also changed, providing a new path for the utilisation of the energy entrained in the highly super heated discharge gas vapour. By stimulating the valve electrically, the position of the U-shaped yolk can be changed from a non-energised state to an energised state. In the non-energised state, the path of flow is between ports D and a, and ports c and b. In the energised state the path of flow is between ports D and b, and ports a and c. Referring to the sketch, the unbroken lines illustrate the energised state and the broken lines illustrate the non-energised state.

The system illustrated in FIG. 3 operates as follows.

For summer cooling cycle of operation, when the diversion valve 39 is in the non-energised state, the indoor fan coil 32 refrigerant suction is relieved via ports b and c, and flows back to the suction port of the compressor 37. The discharge gas from the compressor 37 travels to port D to port a, and, after leaving the diversion valve 39, the discharge enters the diversion valve 38 through the port D and then exits port b, (which is in an energised state). The refrigerant then enters the outside fan coil heat exchanger 31 or the like. The highly super heated discharge gas vapour gives up its thermal energy, to the air, saturating back to a liquid refrigerant. It then travels through to the valve 36, entering port C thereof. With cooling in demand inside the home, the indoor fan coil 32 is utilised when ports C and A are open, and when port B is closed. The refrigerant then enters the valve 34, where the evaporation of the refrigerant occurs in the indoor fan coil heat exchanger 32. When the inside temperature is satisfied, the system will cycle on and off, controlled by the inside thermostat. The indoor fan coil 33, being the secondary cooling device is also controlled by a thermostat. When the fan coil evaporator 32 switches off, controlled by the thermostat, and cooling is in demand for the fan coil evaporator 33, the secondary demand thermostat will signal that the valve 36 is to be energised to open ports C and B and to close port A. The refrigerant then flows back through port a and c of diversion valve 38, returning back to the intake or the suction port of the compressor 37. Since the diversion valve 38 has been energised, the discharge flows from port D to port b to enter the finned tube type aluminium heat exchanger outside fan coil 31 to dissipate discharge gas thermal energy to the outside environment.

For the winter cycle of operation, home heating is required by the fan coil heat exchangers 32 and 33. The primary demand for home heating is in the fan coil heat exchanger 32, and the secondary demand for home heating is the fan coil heat exchanger 33. Therefore the electronic management equipment is programmed to service the home heating primary demand 32 on priority, and then utilise the secondary demand 33 when satisfied. When both 32 and 33 are satisfied the system will cycle on and off, controlled by the thermostats, but maintaining the primary demand 32 on priority, if it is selected for priority or 33 for priority with interchangeable priorities.

With the fan coil heat exchanger 32 activated to perform heating, the diversion is valve 39 is energised such that the discharge gas flows from port D to port b, to enter the indoor fan coil heat exchanger 32, consequently provide air heating. The highly super heated refrigerant gas vapour gives up its thermal energy to the air, therefore condensing it to a liquid. After travelling through the valve expansion device 34, it enters the valve 36, which has been energised to open ports A and C and to close port B. As the refrigerant passes through this port configuration, it enters the fan and coil heat exchanger 31, expanding and collecting energy by operating as an evaporator from the outside ambient air, turning into a vapour and returning to the compressor via port b and c of diversion valve 38 (which is non-energised) to once more repeat the refrigeration cycle. When the home heating priority demand 32 is satisfied, and when home heating secondary demand 33 is still in demand, the diversion valve 39 is energised so as to let the discharge gas travel from port D to port a, and then enter diversion valve 38 (which is in a non-energised state). The discharge gas enters port D and exits port a to flow to the indoor fan coil heat exchanger 33, where the highly super heated refrigerant gas vapour relinquishes its thermal energy to the air. Simultaneously the valve 36 is energised to provide the opening of ports B and C and close port A. The condensed liquid refrigerant then travels through the valve expansion device 35, evaporating into the outside fan coil heat exchange 31 to collect energy from the outside ambient air. The refrigerant expands turning into a vapour and returning through port b and c of the diversion valve 38 to the suction port of the compressor 37. Hence the refrigeration cycle operation is complete.

In winter, the accumulation of frost on the outside fan coil heat exchanger 31 as the refrigerant temperature will be in most cases lower than the 0° C. frost accumulation, may result. It is therefore necessary to provide a defrost cycle to prevent the excessive build up of frost and consequently reduce the efficiency of the air type extended aluminium finned tube heat exchanger 31. The electronic management equipment will be programmed to provide this defrost cycle when required, to maintain optimum efficiency of operation. It has priority over all other functional demands. The defrost cycle will have a thermostat, which senses the temperature of the outside fan coil 31, to initiate at −10° C. and reset at +10° C. when the defrost is complete. In the defrost cycle of operation, when the diversion valve 39 is energised the discharge gas flows from port D to port a. After leaving, it enters port D of the diversion valve 38, and then leaves port b to enter the outside fan coil 31. As the highly super heated discharge gas vapour enters the outside fan coil-heat exchanger 31, any frost build up is defrosted until the thermostat reaches +10° C. The system will thereafter service the functional demands as programmed into the electronic management equipment. The highly super heated discharge gas vapour therefore gives up its thermal energy to defrost the ice and therefore turns to a liquid refrigerant. It then enters the valve expansion device 35 and travels to the valve 36 which has been energised so that ports C and A are open, and such that port B is closed. The evaporating refrigerant collects thermal energy from the inside fan coil heat exchanger 32 which is at a higher temperature. As it turns to a vapour, it returns to the compressor through port b and c of the diversion valve 39 (which is non-energised). It then enters the suction port of the compressor 37, completing the defrost cycle of operation.

Figure 4:
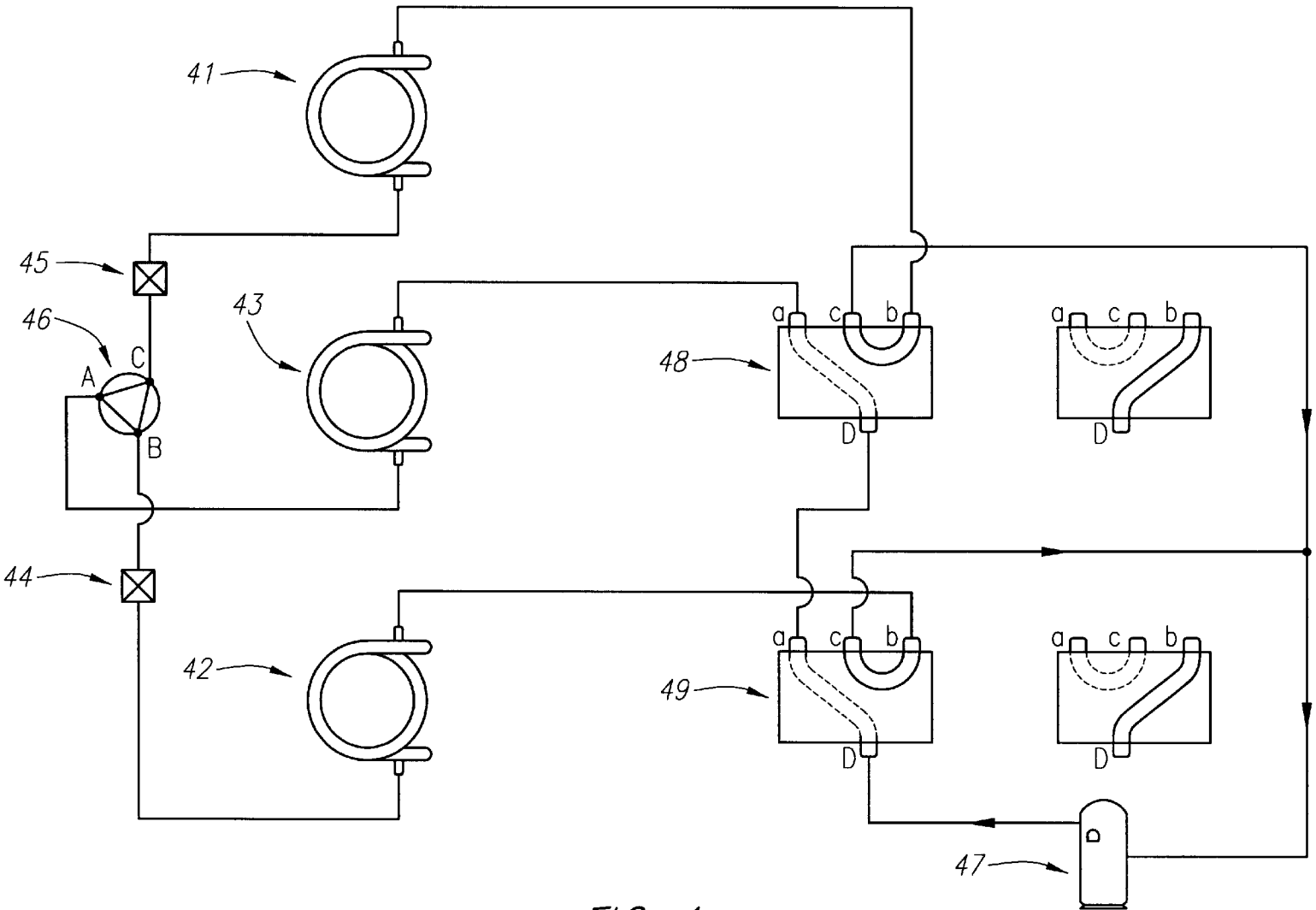
FIG. 4 shows a fourth embodiment of the system.
Figure 5A:
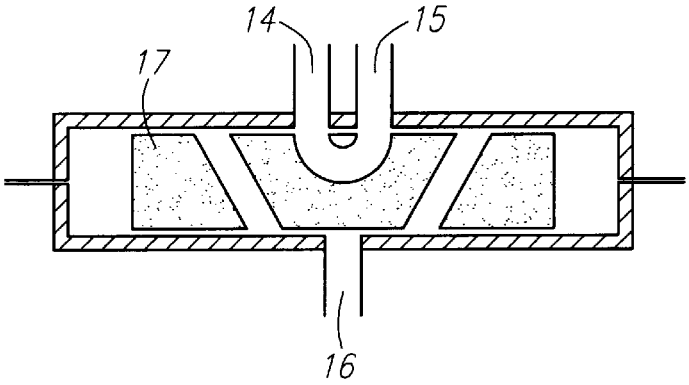
FIG. 5 shows a first embodiment of three way valve in accordance with a second aspect of the present invention.
Figure 5B:
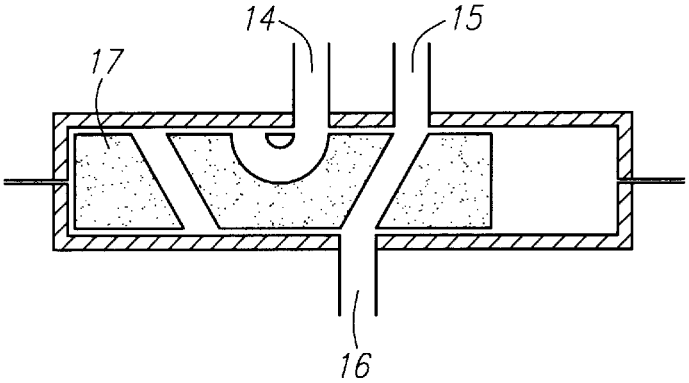
Figure 5D:
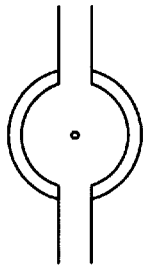
Figure 5C:
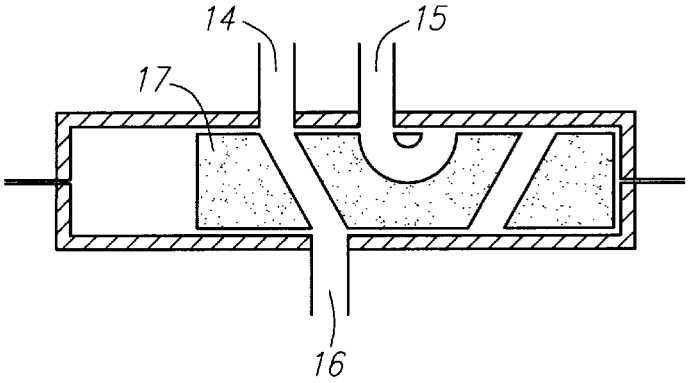

In FIG. 4, is shown yet a further variation to the systems illustrated in FIGS. 1 to 3, constituting a fourth embodiment of the present invention. This embodiment has, three tube within a tube type thermal heat exchangers.

This application is particularly suited to a commercial resort, hotel, retirement home or the like, where hot water is in demand continuously for washing etc. This system design takes into consideration the storage of recoverable energy from waste hot water. The commercial laundry uses copious quantities of water paying to heat the water, and then, after use, discards it down the drain. With the use of a storage vessel, the energy may be recovered before it is discarded to waste and recycled to the incoming uncontaminated fresh water heater tank or vessel, therefore reducing running costs by recycling normally discarded energy for waste water. As the discarded amount of hot water being used is not accumulated instantaneously there will be a period when recovery is not practical. The period of recovery of energy from thermal storage pool is not practical until enough waste hot water is accumulated for another cycle of recovery. Thereafter, continuous energy recovery of the laundry waste water is possible in normal working hours. If any deficiencies are experienced, energy may be recovered from the thermal storage pool, until the short fall may be made up over night or within a period of time.

Some of the other applications for this system are as follows: thermal storage reservoir for storage of heat energy to water, and the separate storage chilled water for secondary cooling and heat means, with the uses of circulation pumps to circulate chilled water or hot water to the water type tube with aluminium extended fin air fan coil for the cooling and heating means, with the primary energy source being river water, sea water, artesian water and/or the like; a pharmaceutical manufacturer waste water recovery, to hot water portable and cooling tower energy recovery to portable hot water; suburban water energy loop circuits providing cooling water loop circuit & heated water loop circuits, individually piped to residential homes for cooling and heating.

Each of the components illustrated in FIG. 4 operates as follows: The Heat Recovery Coil 41 comprises a circulation pump for the movement of water passing through the tube in a tube type heat exchanger coil, commonly known as an evaporator coil and used for the recovery of thermal energy from waste hot water in a storage reservoir or the like.

The Thermal Pool Storage Coil heat exchanger 42 operates with the use of a circulation pump, commonly used for the circulation of water through tube-in-tube type thermal heat exchanger coils used for energy recovery from a thermal storage pool, tank, or the like. Where energy is collected by a refrigerant as it passes through these coils at a much lower temperature than that of the water, the refrigerant evaporates turning from a liquid to a gas, thereby absorbing heat energy.

The hot water heat exchanger 43 is a tube-in-tube type heat-exchanger coil condenser where highly super heated discharge gas is cooled, where it gives up its thermal energy to the water in the hot water storage tank or the like, with the use of a circulation pump.

The thermostatic expansion valves, (valves) 44 and 45 primary function to expand refrigerant from a liquid to a vaporous state, whereby a pressure drop allows evaporation to occur. The thermostatic expansion valve regulates the amount of refrigerant into the said evaporator for the efficient collection of energy either in an air type heat exchanger or water type heat exchanger, optionally vented, or the like.

The valve 46 is a special purpose valve designed and built to provide bi-flow multi directional operational functions. When ports A and C are open, port B is closed. When ports A and B are open, port C is closed, and, when ports B and C are open, and port A is closed. With these port configurations, it is possible to divert refrigerant to different thermal heat exchangers, as required, to either dissipate energy or collect energy.

The Compressor 47 functions to create the refrigeration effect. As refrigerant is sucked into the suction port of the compressor, it is then compressed, thereby reducing its volume to a smaller space. The function of this is that the temperature of the gas increases and the pressure. By cooling this now highly super heated discharge vapour in the thermal heat exchanger, the refrigerant losses its thermal energy and reconverts to a liquid, which may then be reused.

The diversion valves 48 and 49, each have four tubes which are affixed. The function is to change the refrigerant flow.

The diversion valve in this system design is used for the function of diverting the refrigerant from one heat exchanger to another. It is used for relieving refrigerant, to allow it to be recovered by the compressor suction, to be used in another part of the system upon demand. The discharge direction is also changed, providing a new path for the utilisation of the energy entrained in the highly super heated discharge gas vapour. By manipulating the valve electrically, the position of the U-shaped yolk can be changed from an non-energised state to an energised state. In the non-energised state, the path of flow is between ports D and a and ports c and b. Consequently, in the energised state, the path of flow is between ports D and b and ports a and c. Referring to FIG. 4, the unbroken U-shaped curved lines illustrate the energised state, and the broken U-shaped curved lines illustrate the non-energised state.

The system illustrated in FIG. 4 operates as follows, to achieve hot water and waste water heat recovery to portable water. When the diversion valve 49 is in the non-energised state the tube-in-tube thermal water storage heat exchanger 42 suction is relieved via ports b and c, and the discharge gas travels from ports D to a. After leaving diversion valve 49, the discharge enters through the port D of the diversion valve 48, and exits port a, (which is also non energised). It then enters the water cooled tube-in-tube hot water heat exchanger 43 or the like. The highly super heated discharge gas vapour gives up its thermal energy to the water stored in the tank or vessel, reconverting and saturating it to a liquid refrigerant. It then travels through to the valve 46, entering port A. With no waste water recovery in demand inside the waste water tank or vessel, the thermal pool storage heat exchanger coil is utilised when ports A and B are open and port C is closed. The refrigerant then enters the valve 44 where the evaporation of the refrigerant starts in the thermal pool storage coil heat exchanger 42, collecting energy from the pool or thermal storage tank, or the like. The refrigerant vapour leaves the thermal pool storage coil evaporator 42 and enters port b and exits port c of diversion valve 49 to return to the suction port of the Compressor 47 to repeat the refrigeration cycle. The thermal pool storage heat recovery continues to recover energy from the pool storage water, until such time as the waste water, storage tank or vessel is full, ready for the next hot water recovery cycle, or, the uncontaminated fresh hot water temperature is satisfied. The hot water waste recovery reservoir or tank temperature is controlled with the use of a thermostat and when the desired minimum set point for the water temperature is achieved, the thermostat will signal that the electronic management equipment that the storage vessel or tank is to be emptied with the use of pump or drain valve via a float level switch. Hence, until the storage tank or reservoir is filled to activate the float switch to commence waste water energy recovery, the valve 46 is to be energised to open ports A and C, and to close port B to return to hot water waste water recovery cycle. In the event that the hot water storage tank or vessel or the like, is satisfied, the hot water waste water recovery will continue to supply energy to the thermal storage pool, to be stored and utilised in the next hot water demand cycle. The waste hot water recovery to thermal storage pool cycle, occurs when diversion valve 49 is in the energised state. The discharge gas enters port D and exits port b to enter the tube in tube thermal pool storage heat exchanger 42, where the highly super heated discharge vapour gives up its thermal energy to the thermal storage pool. It turns into a liquid refrigerant and travels to the valve 46, entering port B and leaving port C. It then enters the Valve 45 where evaporation of the refrigerant starts, flowing to the waste water recovery evaporator, to collect waste water energy. The refrigerant evaporating inside the evaporator collects energy then travels back to the compressor, entering port b of the diversion valve 48, and exiting port c to return to the compressor 47, concluding the waste water to thermal storage cycle, until the waste water recovery thermostat signals to the electronic management equipment that the minimum water temperature has been achieved.

A defrost cycle of operation is provided in the event of the hot water waste recovery cooling coil tube in tube heat exchanger 41 freezes and reduces the performance. Timed de-ice cycle of operation occurs as the recovery of energy from the waste water may present the accumulation of ice-build up in the waste water tube in tube water chiller evaporator coil heat exchanger 41. As the refrigerant temperature can be in most cases lower then the 10° C. , ice accumulation may be prevalent. It is therefore necessary to provide a defrost cycle to prevent excessive build up of ice which reduces the efficiency of the tube in tube water chiller evaporator heat exchanger. The electronic management equipment will be programmed to provide this de-ice cycle whenever required to maintain the optimum efficiency of the operation. It has priority over other functional demands, to maintain efficient operation. The de-ice cycle will have a thermostat sensing the temperature of the tube in tube water chiller evaporator coil heat exchanger 41, initiating at 0° C., and resetting at +10° C. when the defrost is complete. The de-ice cycle operates, when the diversion valve 49 is non-energised. The discharge gas flows from port D to port a. After leaving, it enters port D of diversion valve 48 (which is energised) and leaves port b to enter the tube in tube water chiller evaporator coil heat exchanger 41. As the highly super heated discharge gas vapour enters the tube-in tube water chiller evaporator coil heat exchanger 41, the ice build up is defrosted. When the thermostat reaches +10° C. the system will service the functional demands as programmed into the electronic management equipment. The highly super heated discharge gas vapour gives up its thermal energy to defrost the ice and therefore convert to a liquid refrigerant. It then enters the Valve expansion device 45 and travels to the valve 46 which has been energised so that port C and B are open and port A is closed. The expanding refrigerant collects thermal energy from the thermal water storage pool or the like. As it turns to a vapour it returns to the compressor via the diversion valve 49 through port b and c, (which is non-energised), and enters the suction port of the compressor to complete the de-ice cycle of operation.

As will be understood from the description of FIGS. 1 to 4, provided hereinbefore, instead of providing totally separate components which have no functional inter-relationship, which is performed by the prior art, a single reversible thermal circuit is provided by the present invention, utilising one or more heat exchangers to distribute heat between heating means and cooling means. For example, in summer, with an outside air temperature of say 30° C., the desired temperature inside the house might be 21° C., and the desired pool temperature might be 28° C. The energy management unit is operated similarly to a conventional air conditioning unit, and whilst operating, the heat expelled from the air conditioning process is recovered by a heat exchanger and utilised to heat the swimming pool. Consequently, rather than having to operate a separate heating unit, solely for the swimming pool, the pool heating is derived from the expended heat from the air conditioning cycle. The temperature of the house and the pool may be monitored by a thermometer, and appropriate thermostats then be provided to operate and activate the operation of the energy management system.

It will be appreciated that the most useful forms of the invention are wherein both heating and cooling operations are desired, however, it would be appreciated that at certain times of the year, such as in winter, additional energy might be expended since the demands for heating are much higher than the demands for cooling. Obviously additional capacity should be supplied to cope with this.

There are numerous applications to the present invention, preferred but non-limiting examples of which will be listed hereinafter:

| HEATING | COOLING |
|---|---|
| Air conditioning heat | Air conditioning cooling |
| Air heating twin coils | Air cooling twin coils |
| Spa heating | |
| Green house heating air/$H_2O$ | Green house cooling air/$H_2O$ |
| Pool heating | |
| Clothes drying air | |
| Slab heating $H_2O$ | Slab cooling $H_2O$ |
| Hot water heating | |
| COMMERCIAL AIR CONDITIONING HEATING & COOLING | |
| Multi story building heating | Multi story building cooling |
| Hot water | |
| RESORTS, CLUBS, HOTEL/MOTEL, RETIREMENT & NURSING HOMES, etc. | |
| Air heat split coils | Air cooling split coils |
| Air heating | Air cooling |
| Pool heating $H_2O$ | |
| Hot water $H_2O$ | Laundry space cooling air |
| Hot water recovery $H_2O$ | Cool room cooling |
| Clothes drier air | Waste food cool room |
| Lawn greens heating $H_2O$ | |
| Slab heating $H_2O$ | Slab cooling |
| HORTICULTURAL HEATING & COOLING | |
| Bed heating $H_2O$ | Bed cooling $H_2O$ |
| Green house heating air | Green house cooling air |
| Propagation bed heating $H_2O$ | Cooling $H_2O$ |
| PHARMACEUTICAL INDUSTRY MANUFACTURERS | |
| Air conditioning heat | Air conditioning cooling |
| Hot water recovery | Air energy cooling recovery |
| Hot water make up | |
| Pasteurisation heating | Pasteurisation cooling |
| | Cool room storage |
| COMMERCIAL FOOD RETAILER Supermarkets, fast food chains e.g. Coles, Woolworths, McDonalds, Sizzlers, etc. | |
| Air conditioning heating | Air conditioning cooling |
| Hot water | |
| Hot water recovery | Recovery energy cooling |
| Pasteurisation heating | Pasteurisation cooling |
| ABATTOIRS MEAT, POULTRY, SMALL GOODS MANUFACTURERS | |
| Production, warehouse, packaging, pre-cooling, refrigeration, industrial processes | |
| SPORTS CENTRES GYMS & RECREATIONAL CENTRES | |
| Air conditioning heating | Air conditioning cooling |
| Pool heating | |
| Spa heating | |
| Slab heating | |
| Hot water | |
| COMMERCIAL LAUNDRIES ENERGY MANAGEMENT | |
| Hot water storage | Air conditioning cooling from work space to recovery hot water |
| Clothes drier | Air cooling recovery of waste energy to hot water storage and/or to cloths drier pre-heat |
| Hot water storage | |
| Drier cloths passive heat | |
| Air conditioning heat | Air conditioning cooling |
| Waste to storage | Waste heat to storage |

-continued

| CO-GENERATION OF TWO NEEDS ONE HEATING & ONE COOLING DESCRIPTION: The conditional circumstances of this kind of energy management system are that two common or separate entities which require separate cooling and separate heating. It would require their location to be strategically placed in as close proximity as possible, for the reduction of construction costs. | |
|---|---|
| HEATING REQUIREMENTS | COOLING REQUIREMENTS |
| Olympic pool heating | Resort, Club, Uni, entertainment complex, etc. Cooling |
| Pool heating | Ice Skating Rink cooling |
| | Business complex cooling |
| Hydroponics heating | Cool room storage green house |
| | Cool room storage |
| | Offices air conditioning |
| | Residential cooling |
| Olympic Pool heating recovery | Cold store facility cooling |
| Hot water | Air conditioning cooling |
| THERMAL STORAGE SYSTEMS WATER & PHASE CHANGE MATERIALS | |
| Thermal heating storage bank | Thermal cooling storage bank |
| Slab reticulated heating | Slab cooling |
| Green house reticulated heat | Green house cooling air |
| Air conditioning heating | Air conditioning cooling |

These types of thermal storage systems can be utilised on a multitude of applications where water or fluid pipe lines can be attached to the storage vessels and pipe to the various heating and cooling coils as required. Commonly known as secondary cooling and heating systems.

It will be appreciated that by utilising a system as hereinbefore described, since waste thermal energy is eliminated, or at least reduced, fuel costs and therefore system running costs are dramatically reduced.

It will be understood by persons skilled in the art that a central processing unit is preferably utilised to control the overall operation of the system. The actual design considerations, etc., of such a central processing unit will become obvious to persons skilled in the art, depending, of course, on the particular installation of the system.

It will be appreciated that there are a variety of forms of actually embodying the present invention, however, it will be appreciated that appropriate thermostats, the utilisation of the certain forms of heat exchangers refrigerant gases, etc., will be all chosen by persons skilled in the art.

In another aspect, the present invention also relates to a three way valve, which is illustrated in FIGS. 5 to 8. The valve is of FIGS. 5 to 8 embodied in the system Figures. 1 to 4, and designated by the numeral 16 in the first embodiment, 26 in the second embodiment, 36 in the third embodiment and 46 in the fourth embodiment.

The three way valve 13 is effectively a valve which allows bi-directional flow of fluid in any two of three inlet/outlet paths. As will be appreciated, this permits the same system components to be utilised for different functions. For example, in one season, say summer, heat may be desired to be transferred from a first to a second heat exchanger, whilst in another season, say winter, it may be required to be transferred in the opposite direction. In the past, separate systems have been required.

Figure 6A:
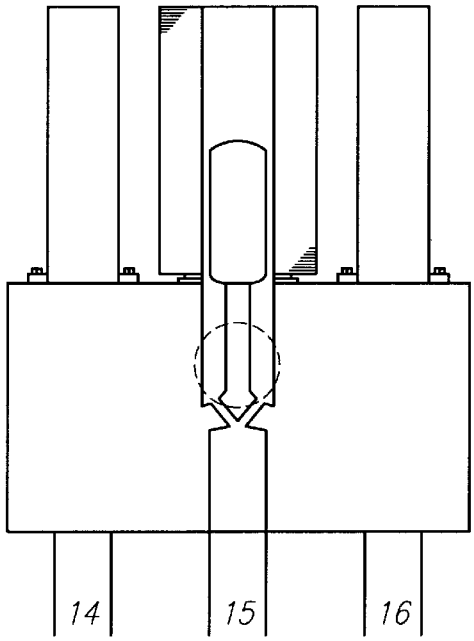
FIG. 6 shows a second embodiment of the valve.
Figure 6B:
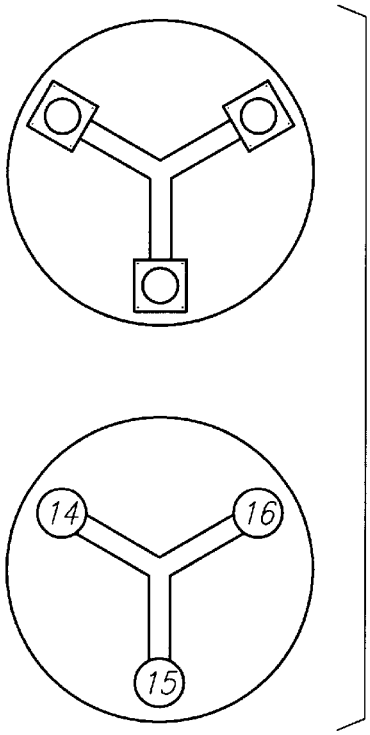
Figure 7A:
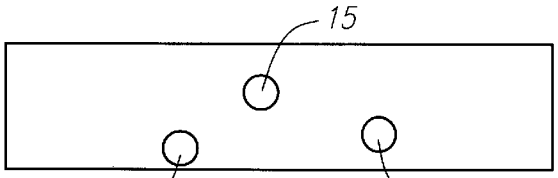
FIG. 7 shows a third embodiment of the valve.
Figure 7B:
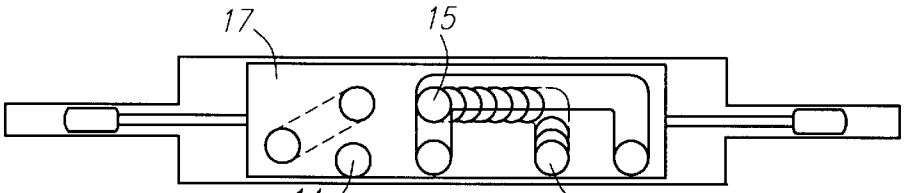
Figure 7C:
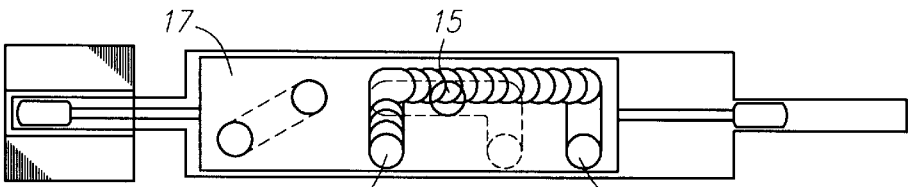
Figure 7D:
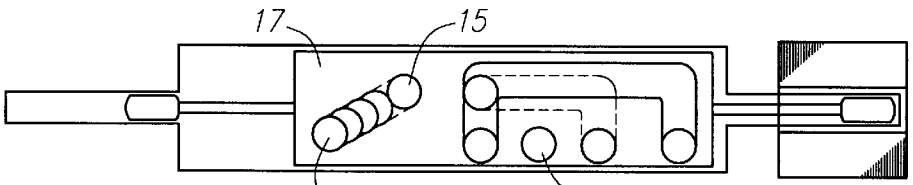
Figure 7E:
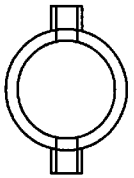
Figure 8A:
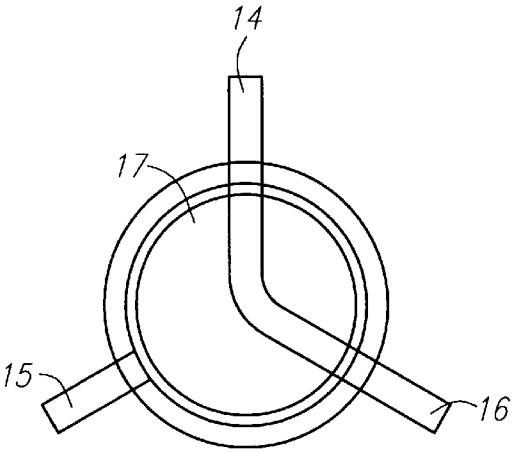
FIG. 8 shows a fourth embodiment of the valve.
Figure 8B:
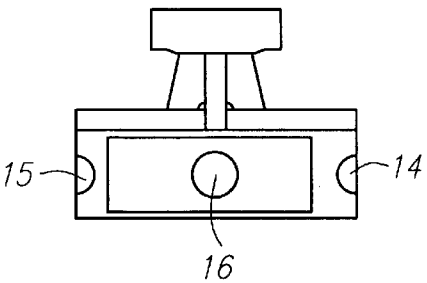
Figure 8C:
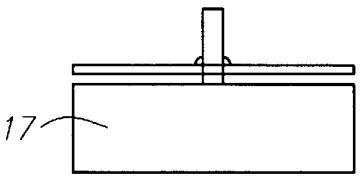
Figure 8D:
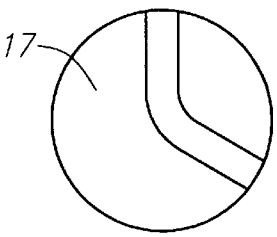

The three way valve may be implemented in a variety of configurations, as shown in FIGS. 5 to 8, wherefrom, the operation of the valve will be understood to persons skilled in the art. As shown, the valves have three inlet/outlet paths 14, 15 and 16, and the alignment of two of the three paths is achieved by movement of a moveable member 17. The moveable member 17, in FIGS. 5 to 7 is embodied as a slidable member operable by a pilot or solenoid, whilst in FIG. 8 is embodied as a rotatable member operable by a servo motor.

It will be understood that the basic criteria for the design of heat pump energy management technology, in accordance with the present invention are as follows:

Environmental impact reduction

Maximising recycled and recovered energy

Reduction in $CO_2$ emissions

Reduction in discharged waste energy

A critical charge, refrigeration heat pump is most preferably used. The design of such a heat pump, in having no liquid storage container therein, e.g. liquid receiver used, is that no unnecessary refrigerant disbursement occurs to the ozone, being the critical charge.

There is a diverse application range for the present invention, covering water and air, heating and cooling and recovery of heat energy which may be wasted, not limited to and including the thermal ground circuits and or artesian water, dam, river or cooling ponds.

The valve construction can be of the following materials for purposes of other liquid fluids or other gases, and may be used for transferring liquids, fluids and/or gases, whether heated or cooled or not, e.g. water, oil, steam, glycols, ethylene glycols, phase change fluids, or other.

The valve may be constructed of various material types and composites, including plastics, nylons, ferrous metals, non ferrous metal, Ostolon and polypropylene teflon, or the like.

All such variations and modifications to the present invention which become obvious to persons skilled in the art, should be considered to fall within the scope of the invention.

What is claimed is:

1. A heat transfer assembly comprising:

a first, second and third heat exchanger;

a compressor to provide compressed refrigerant for selective delivery to the heat exchangers;

an expansion valve for each of said first and second heat exchangers to selectively deliver expanding refrigerant thereto;

a control valve assembly communicating with the heat exchanges, expansion valves and compressor to coordinate circulation of the refrigerant so that compressed refrigerant can be delivered to said third heat exchanger and expanding refrigerant delivered to said first or second heat exchangers, or compressed refrigerant is delivered to said first or third heat exchangers and expanding refrigerant delivered to said second heat exchanger, or compressed refrigerant delivered to said second heat exchanger and expanding refrigerant delivered to said first heat exchanger, or expanding refrigerant is delivered to said third heat exchanger and compressed refrigerant is delivered to said first or second heat exchangers, said valve assembly also being configured to drain refrigerant from any one of said first, second or third heat exchangers, when inoperative, to said compressor.

2. The heat transfer assembly of claim 1, wherein said valve assembly includes a first, a second and a third valve device, said first valve device coupling said first heat exchanger with said compressor to receive refrigerant from or deliver refrigerant to the compressor, and connecting the second valve device to said compressor so as to deliver compressed refrigerant thereto, said second valve device being connected to said third heat exchanger to deliver compressed refrigerant thereto or to drain refrigerant therefrom for delivery to the compressor, and to deliver compressed refrigerant to said second heat exchanger or drain refrigerant therefrom for delivery to said compressor, said third valve device being connected to said first heat exchanger via the expansion valve associated therewith to isolate or to receive refrigerant from or deliver refrigerant to said first heat exchanger, said third valve device also being connected to said second heat exchanger via the expansion valve associated therewith to isolate or to deliver refrigerant to or receive refrigerant from the second heat exchanger, said third valve device further being coupled to said third heat exchanger to isolate the third heat exchanger or to receive refrigerant therefrom or to deliver refrigerant thereto.

3. The heat transfer assembly of claim 1 or 2, wherein said first heat exchanger is located internally of a building, said second heat exchanger is located externally of the building, and said third heat exchanger is associated with a body of water to deliver heat thereto.

4. The transfer assembly of claim 3, wherein said body of water is a swimming pool or water heater or the like.

5. The heat transfer assembly of claim 1 or 2, wherein said first heat exchanger is located internally of a building, said second heat exchanger is associated with a supply of heated water to receive heat therefrom, and said third heat exchanger is associated with a hot water heater to deliver heat thereto.

6. The heat transfer assembly of claim 1 or 2, wherein said first and third heat exchanges are located internally of a building, and said second heat exchanger is located externally of the building.

7. The heat transfer assembly of claim 1 or 2, wherein at least one of the heat exchangers is associated with a supply of hot water to recover heat energy therefrom and at least one of the heat exchangers is associated with a water heater to deliver heat thereto.

* * * * *

UNITED STATES PATENT AND TRADEMARK OFFICE

CERTIFICATE OF CORRECTION

PATENT NO. : 6,082,125
DATED : July 4, 2000
INVENTOR(S) : Savtchenko

It is certified that error appears in the above-identified patent and that said Letters Patent is hereby corrected as shown below:

Title page,
Item [56], Foreign Application Priority Data, please change "Feb. 24, 1997" to -- Feb. 23, 1996 --.

Signed and Sealed this

Seventeenth Day of September, 2002

*Attest:*

*Attesting Officer*

JAMES E. ROGAN
*Director of the United States Patent and Trademark Office*